US011543123B2

(12) United States Patent
Perez et al.

(10) Patent No.: US 11,543,123 B2
(45) **Date of Patent: *Jan. 3, 2023**

(54) BURNER BOX LINER FOR LOW NOX EMISSION FURNACE

(71) Applicant: Lennox Industries Inc., Richardson, TX (US)

(72) Inventors: Eric Perez, Hickory Creek, TX (US); Randal Poirier, The Colony, TX (US); Eric Chanthalangsy, Grand Prairie, TX (US); Steven Schneider, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 264 days.

This patent is subject to a terminal disclaimer.

(21) Appl. No.: 16/899,886

(22) Filed: Jun. 12, 2020

(65) Prior Publication Data

US 2020/0340666 A1 Oct. 29, 2020

Related U.S. Application Data

(63) Continuation of application No. 15/723,564, filed on Oct. 3, 2017, now Pat. No. 10,711,997.

(51) Int. Cl.
*F23D 14/02* (2006.01)
*F23D 14/60* (2006.01)
(Continued)

(52) U.S. Cl.
CPC ..... *F23D 14/60* (2013.01); *F23D 14/02* (2013.01); *F23D 14/62* (2013.01); *F23L 17/005* (2013.01);
(Continued)

(58) Field of Classification Search
CPC ..... F24H 8/006; F24H 9/0068; F23D 2900/00018; F23D 2208/00; F23D 14/60; F23D 14/62; F23D 14/02
(Continued)

(56) References Cited

U.S. PATENT DOCUMENTS 4,087,234 A 5/1978 Delyannis
4,318,688 A 3/1982 Buschulte et al.
(Continued)

FOREIGN PATENT DOCUMENTS

CA 2132915 C * 5/2000 ..... F23M 20/005
DE 69603389 T2 4/2000
(Continued)

OTHER PUBLICATIONS

U.S. Appl. No. 15/723,340, Perez, et al.
U.S. Appl. No. 15/723,564, Perez, et al.
U.S. Appl. No. 15/723,284, Perez, et al.

*Primary Examiner* — Avinash A Savani
(74) *Attorney, Agent, or Firm* — Shackelford, Bowen, McKinley & Norton, LLP

(57) ABSTRACT

A burner box assembly according to aspects of the disclosure includes an outer cover, the outer cover having a sloped bottom face that directs condensation away from a heat-exchange tube, a heat-resistant liner having a plurality of panel members, the heat-resistant liner being disposed within the outer cover, a shield disposed between the heat-resistant liner and the sloped bottom face of the outer cover such that an air gap is formed between the shield and the sloped bottom face, and a tubular member abutting at least one of the plurality of panel members and disposed within the heat-exchange tube.

16 Claims, 7 Drawing Sheets

(51) Int. Cl.

| | |
|---|---|
| ***F23L 17/00*** | (2006.01) |
| ***F23D 14/62*** | (2006.01) |
| ***F24H 8/00*** | (2022.01) |
| *F24H 9/00* | (2022.01) |

(52) U.S. Cl.
CPC ..... *F24H 8/006* (2013.01); *F23D 2208/005* (2013.01); *F23D 2900/00018* (2013.01); *F24H 9/0068* (2013.01)

(58) Field of Classification Search
USPC ..... 60/752
See application file for complete search history.

(56) References Cited

U.S. PATENT DOCUMENTS

| | | | | |
|---|---|---|---|---|
| 4,515,145 | A | 5/1985 | Tallman et al. | |
| 4,541,411 | A | 9/1985 | Woolf | |
| 4,561,421 | A | 12/1985 | Hwang et al. | |
| 4,900,245 | A | 2/1990 | Ahmady | |
| 5,311,930 | A | 5/1994 | Bruenn | |
| 5,893,358 | A | 4/1999 | Whitfield | |
| 6,129,628 | A | 10/2000 | O'Hagin et al. | |
| 6,238,206 | B1 | 5/2001 | Cummings, III et al. | |
| 8,616,194 | B2 * | 12/2013 | Sherrow | F24H 3/087 126/110 A |
| 9,316,411 | B2 * | 4/2016 | Sherrow | F24H 9/0068 |
| 9,772,119 | B2 * | 9/2017 | Shellenberger | F23D 14/62 |
| 10,281,143 | B2 | 5/2019 | Batson et al. | |
| 2004/0068970 | A1 | 4/2004 | Hasegawa et al. | |
| 2005/0048430 | A1 * | 3/2005 | Steiner | F23D 23/00 431/278 |
| 2005/0076621 | A1 | 4/2005 | Chang | |
| 2008/0314378 | A1 | 12/2008 | Khan et al. | |
| 2009/0098496 | A1 | 4/2009 | Poirier | |
| 2010/0310998 | A1 | 12/2010 | Raleigh et al. | |
| 2012/0024281 | A1 | 2/2012 | Lyons et al. | |
| 2012/0247444 | A1 * | 10/2012 | Sherrow | F24H 3/087 165/104.34 |
| 2013/0277144 | A1 | 10/2013 | Tange et al. | |
| 2013/0302737 | A1 * | 11/2013 | Schultz | F23D 14/58 165/135 |
| 2014/0011143 | A1 | 1/2014 | Barozzi et al. | |
| 2014/0174426 | A1 | 6/2014 | Moon et al. | |
| 2014/0202443 | A1 * | 7/2014 | Sherrow | F23D 14/62 126/112 |
| 2015/0083105 | A1 * | 3/2015 | Akbarimonfared | F24H 9/0052 431/171 |
| 2015/0184850 | A1 | 7/2015 | Seeley | |
| 2015/0192291 | A1 | 7/2015 | Akbarimonfared et al. | |
| 2015/0369495 | A1 * | 12/2015 | Maricic | F24H 8/00 126/104 A |
| 2016/0040905 | A1 * | 2/2016 | Shellenberger | F23D 14/70 431/278 |
| 2016/0102888 | A1 | 4/2016 | Kuckelkorn et al. | |
| 2017/0009981 | A1 * | 1/2017 | Shaw | F23C 5/02 |
| 2017/0009982 | A1 * | 1/2017 | Garloch | F23D 14/105 |
| 2017/0241666 | A1 * | 8/2017 | Kowald | F24H 9/1881 |
| 2017/0241668 | A1 * | 8/2017 | Kowald | F24H 3/087 |
| 2018/0080659 | A1 * | 3/2018 | Brake | F24D 5/02 |
| 2018/0202652 | A1 * | 7/2018 | Batson | F28F 9/167 |
| 2018/0259179 | A1 | 9/2018 | Kowald et al. | |
| 2021/0088211 | A1 | 3/2021 | Daddis et al. | |

FOREIGN PATENT DOCUMENTS

| | | |
|---|---|---|
| EP | 1571398 A2 | 9/2005 |
| EP | 2163820 A1 | 3/2010 |

* cited by examiner

BURNER BOX LINER FOR LOW NOX EMISSION FURNACE

CROSS REFERENCE TO RELATED APPLICATIONS

This U.S. Patent Application is a continuation U.S. patent application Ser. No. 15/723,564, filed on Oct. 3, 2017. This U.S. Patent Application incorporates U.S. patent application Ser. No. 15/723,564 herein by reference. This U.S. Patent Application incorporates by reference for any purpose the entire disclosure of U.S. patent application Ser. No. 15/723,284, filed on Oct. 3, 2017. This patent application incorporates by reference for any purpose the entire disclosure of U.S. patent application Ser. No. 15/723,340, filed on Oct. 23, 2017.

TECHNICAL FIELD

This disclosure relates generally to furnaces utilized with heating, air conditioning, and ventilation ("HVAC") equipment and more specifically, but not by way of limitation, to pre-mix furnace assemblies utilizing heat-resistant shielding to protect interior surfaces of a burner box and having a flow path for accumulated condensation.

BACKGROUND

This section provides background information to facilitate a better understanding of the various aspects of the disclosure. It should be understood that the statements in this section of this document are to be read in this light, and not as admissions of prior art.

Furnaces are common equipment in many commercial and residential HVAC systems. Operation of such furnaces typically includes the controlled combustion of a hydrocarbon fuel such as, for example, propane or natural gas, in the presence of atmospheric air. Theoretically, complete stoichiometric combustion of the hydrocarbon fuel yields carbon dioxide ($CO_2$), water vapor ($H_2O$), Nitrogen ($N_2$), and heat energy. In practice, however, complete stoichiometric combustion of the hydrocarbon fuel rarely occurs due to factors including, for example, combustion residence time and hydrocarbon fuel/air mixture ratio. Incomplete combustion of the hydrocarbon fuel yields combustion byproducts including, for example, carbon monoxide (CO) and various nitrous oxides (NOx). CO and NOx are generally regarded to be environmental pollutants and emissions of byproducts such as CO and NOx are commonly limited by federal, state, and local regulations. NOx, in particular, has recently been the subject of aggressive pollution-reducing agendas in many areas. As a result, manufacturers of furnaces and related HVAC equipment have undertaken efforts to reduce emission of NOx.

SUMMARY

A burner box assembly according to aspects of the disclosure includes an outer cover, the outer cover having a sloped bottom face that directs condensation away from a heat-exchange tube, a heat-resistant liner having a plurality of panel members, the heat-resistant liner being disposed within the outer cover, a shield disposed between the heat-resistant liner and the sloped bottom face of the outer cover such that an air gap is formed between the shield and the sloped bottom face, and a tubular member abutting at least one of the plurality of panel members and disposed within the heat-exchange tube. In some embodiments, the outer cover may include a first aperture formed therein and coupled to the heat-exchange tube. The heat-resistant liner may include a second aperture formed therein. The first aperture may align with the second aperture.

A burner box assembly according to aspects of the disclosure includes an outer cover, a heat-resistant liner having a plurality of panel members, the heat-resistant liner being disposed within the outer cover, and a tubular member coupled to at least one of the plurality of panel members and disposed within a heat-exchange tube.

A furnace assembly according to aspects of the disclosure includes a supply line fluidly coupled to a fresh-air intake, an intake manifold fluidly coupled to the supply line, a pre-mix burner fluidly coupled to the intake manifold, a burner box assembly containing at least a portion of the pre-mix burner, the burner box assembly being thermally exposed to the pre-mix burner and the burner box assembly includes an outer cover having a sloped bottom face, a heat-resistant liner having a plurality of panel members, the heat-resistant liner being disposed within the outer cover, a tubular member abutting at least one of the plurality of panel members and disposed within a heat-exchange tube, the heat-exchange tube being fluidly coupled to the burner box assembly, and a fan fluidly coupled to the heat-exchange tube.

This summary is provided to introduce a selection of concepts that are further described below in the detailed description. This summary is not intended to identify key or essential features of the claimed subject matter, nor is it to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

During operation of a furnace, production of NOx is typically dependent upon factors including, for example, hydrocarbon fuel/air mixture ratio and residence time. In general, combustion of a hydrocarbon fuel/air mixture (e.g. greater than approximately 50% excess air) is desired. Additionally, a well-mixed hydrocarbon fuel/air mixture with a low residence time is desirable for low NOx production and emission. "Residence time" refers to a probability distribution function that describes the amount of time a fluid element could spend inside a chemical reactor such as, for example, a combustion chamber.

Most residential and commercial HVAC equipment utilize induced draft "atmospheric" burners. Atmospheric burners are characterized by an initial mixing of atmospheric air and the hydrocarbon fuel. This is typically accomplished by entraining the atmospheric air into the hydrocarbon fuel stream via, for example, a venturi or other similar device. Atmospheric burners typically operate with a rich hydrocarbon fuel/air mixture and often exhibit a relatively large flame volume. The large flame volume increases combustion residence times, which allows further NOx production to occur. Additionally, combustion in atmospheric burners typically occurs in the presence of excess air. The excess air helps cool the products of combustion and spreads the combustion process over a larger area. The flame is typically drawn or induced by a combustion air blower into a heat exchanger. Such longer combustion times lead to the creation of increased levels of NOx.

Another type of furnace utilizes a pre-mix burner. Pre-mix burners are typically fan powered, which allows the hydrocarbon fuel/air mixture ratio to be carefully controlled in an effort to prevent combustion with excess air. Pre-mix burners operate with a lean hydrocarbon fuel/air mixture and often exhibit short blue flames. Pre-mix burners exhibit short reaction zones and high burning velocities. This leads to short residence time and high combustion efficiency, which limits NOx production and emission.

Figure 1A:
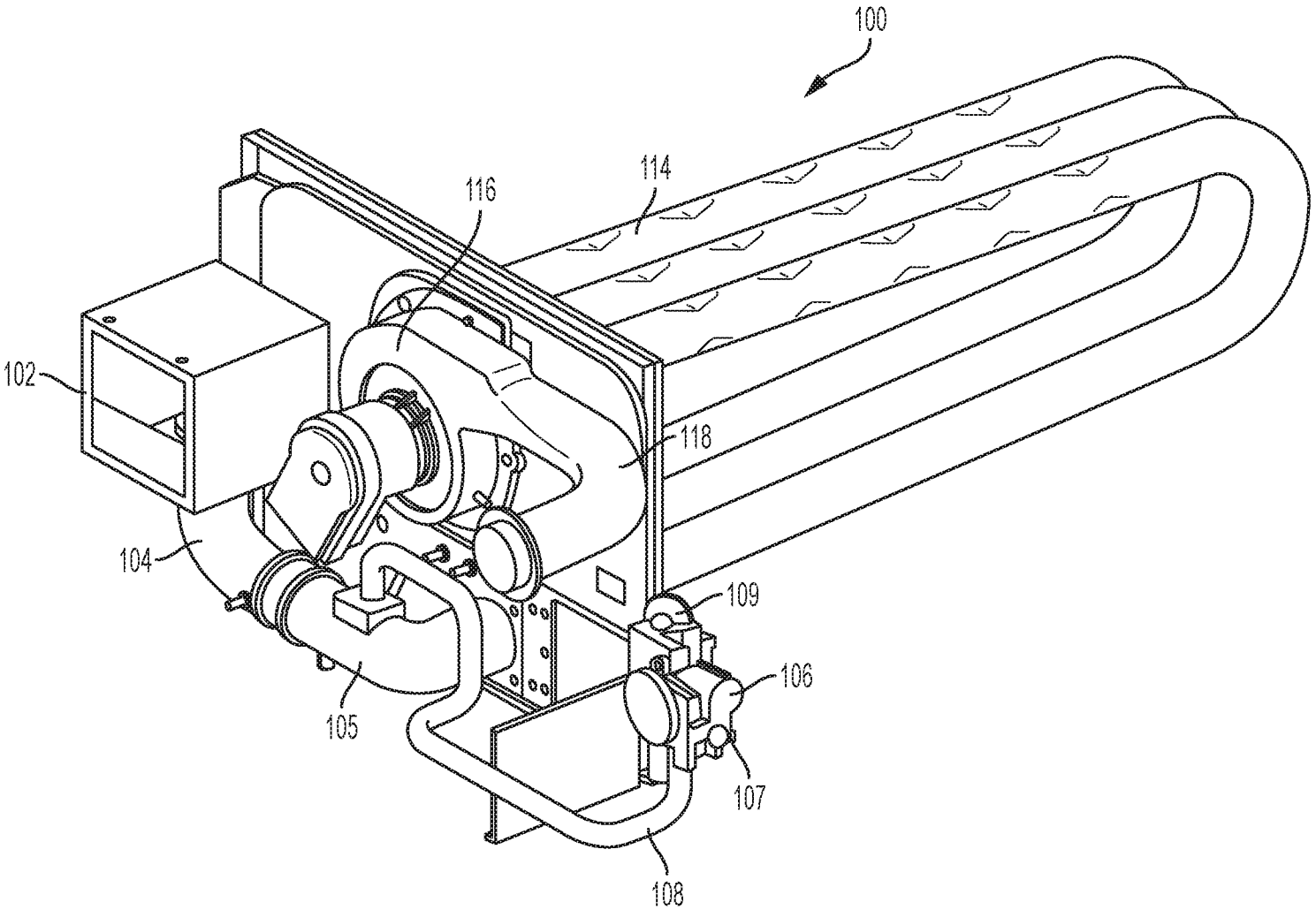
FIG. 1A is a schematic view of an illustrative furnace assembly implementing a burner box with a heat-resistant liner in accordance with one or more aspects of the disclosure.

FIG. 1A is a perspective view of an example of a furnace assembly 100 implementing a burner box liner in accordance with aspects of the disclosure. The furnace assembly 100 includes a fresh-air intake 102 that is fluidly coupled to a supply line 104. The supply line 104 is fluidly coupled to an intake manifold 105. A fuel valve 106 regulates a volume of hydrocarbon fuel that is supplied to a fuel tube 108. In an embodiment, the fuel valve 106 is an electrically-actuated solenoid valve that opens or closes responsive to an electrical current being applied to a terminal 107 of the fuel valve 106. The fuel valve 106 includes a fuel inlet 109. The fuel inlet is fluidly coupled to, for example, a supply of a hydrocarbon fuel. The fuel tube 108 supplies the hydrocarbon fuel to the intake manifold 105. In the intake manifold 105, the hydrocarbon fuel mixes with atmospheric air supplied through the fresh-air intake 102 and the supply line 104 to form a hydrocarbon fuel/air mixture. A fan 116 is fluidly coupled to an exhaust manifold 118. The fan 116 is fluidly coupled to a heat-exchange tube 114. The fan 116 is, for example a squirrel-cage blower.

Figure 1B:
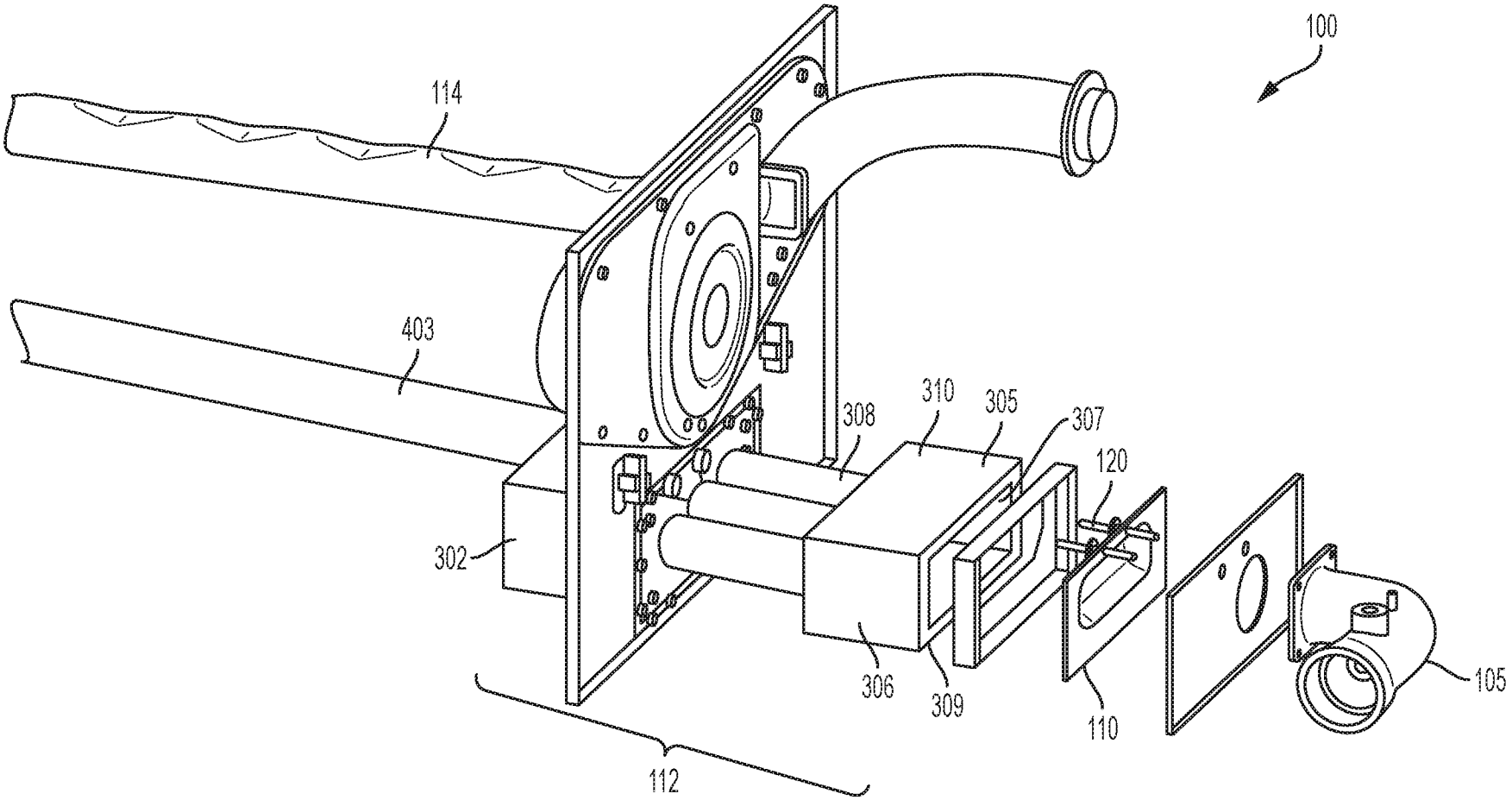
FIG. 1B is an exploded view of the illustrative furnace assembly.

FIG. 1B is an exploded perspective view of the furnace assembly 100 implementing a burner box liner in accordance with aspects of the disclosure. The heat-exchange tube 114 is fluidly coupled to a burner box assembly 112 that is thermally exposed to a pre-mix burner 110. The pre-mix burner 110 is fluidly coupled to the intake manifold 105. During operation, the fan 116 draws the hydrocarbon fuel/air mixture through the intake manifold 105 and through the pre-mix burner 110. The fan 116 controls the mixture ratio of hydrocarbon fuel to atmospheric air to ensure that combustion in excess air is minimized. A low NOx premix combustion system, such as the furnace assembly 100, requires a gas-air linkage to maintain a consistent gas-air ratio. The supply line 104 includes a venturi arranged in a coupling upstream of the intake manifold 105. During operation, the venturi pressure is communicated to the fuel valve 106 through pressure tubing. The fuel valve 106 and a speed of the fan 116 are modulated according to the measured venturi pressure thereby maintaining the proper amount of excess air for combustion. In other embodiments, the pressure in the supply line 104 could be measured electronically using, for example, a pressure transducer. Reducing combustion in excess air reduces production and emission of NOx. Igniters 120 combust the hydrocarbon fuel/air mixture at the pre-mix burner 110. In this example, the igniters 120 utilize an electrical spark to combust the hydrocarbon fuel/air mixture; however, the igniters 120 could utilize, for example, a hot surface or a pilot flame to combust the hydrocarbon fuel/air mixture. The burner box assembly 112 is thermally exposed to the pre-mix burner 110 and contains the combustion of the hydrocarbon fuel/air mixture. The fan 116 continues to draw hot combustion byproducts through the heat-exchange tube 114 and into the exhaust manifold 118. In this manner, the furnace assembly 100 exhibits short combustion residence time when compared to atmospheric burners, which contributes to low NOx production and emission. From the exhaust manifold 118, the combustion byproducts are exhausted to the exterior environment.

Still referring to FIG. 1B, during combustion, temperatures in the burner box assembly 112 can reach, for example, approximately 1,800° F. Such high temperatures subject the pre-mix burner 110 and the burner box assembly 112 to high thermal stresses resulting from, for example, differences in coefficients of thermal expansion. In addition, high combustion temperatures can create hot spots in the burner box assembly 112, which, over time, can lead to stress cracks and fractures in the burner box. Another type of thermal damage that is possible results from burning of the material forming the burner box assembly 112, thereby causing perforations of the burner box assembly 112. Also, high temperatures can cause warping of the burner box assembly 112 resulting in compromised seals and leaks that can compromise the air/hydrocarbon fuel mixture and impact performance of the furnace. In an effort to reduce the thermal stresses imposed on the burner box assembly 112 by the combustion temperatures, the burner box assembly 112 is lined with a heat-resistant material. The burner box assembly 112 includes an outer cover 302. The outer cover 302 is formed from metallic components such as, for example, various steel alloys such as, for example, aluminized steel or 409 stainless steel.

Still referring to FIG. 1B, a heat-resistant liner 310 lines an interior of the outer cover 302. The heat-resistant liner 310 is oxidation and corrosion resistant and retains strength over a wide range of temperatures. The heat-resistant liner 310 has the ability to spread combustion heat over a large area, which raises the temperature of the burner box assembly 112 over a wider area and reduces peak temperatures within the burner box assembly 112. In this manner, the heat-resistant liner 310 prevents the formation of hot spots within the burner box assembly 112. The heat-resistant liner 310 is constructed of a nickel/chromium alloy such as, for example, INCONEL®; however, other heat-resistant materials could be utilized such as for example, a ceramic wafer board or other appropriate material. In various embodiments, the heat-resistant liner 310 may be a mesh; however, the heat-resistant liner 310 could be solid. The heat-resistant liner 310 includes oppositely-disposed spaced panel members 306. A top panel member 305 is disposed between, and generally perpendicular to, the oppositely-disposed, spaced panel members 306. A bottom panel member 309 is spaced from, and generally parallel to the top panel member 305. The bottom panel member 309 is also disposed between, and generally perpendicular to, the oppositely-disposed, spaced panel members 306. An open rear face 307 is defined by the oppositely-disposed, spaced panel members 306, the top panel member 305, and the bottom panel member 309. The open rear face 307 receives at least a portion of the pre-mix burner 110 such that an interior aspect of the heat-resistant liner 310 is thermally exposed to the pre-mix burner 110.

Figure 2:
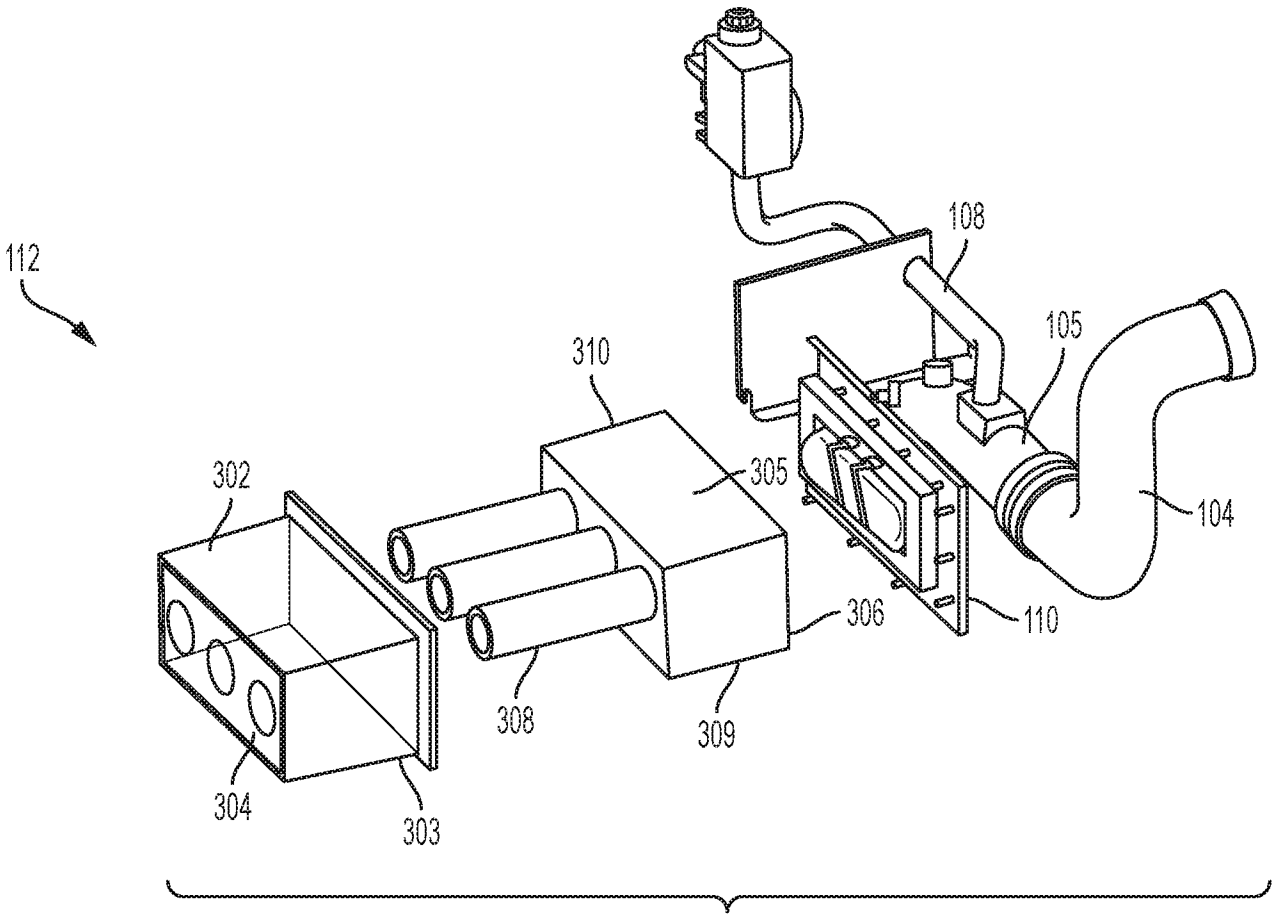
FIG. 2 is an exploded view of an illustrative burner box assembly.

FIG. 2 is an exploded view of an example of the burner box assembly 112 in accordance with one or more aspects of the present disclosure. For purposes of illustration, FIG. 2 will be discussed herein relative to FIGS. 1A and 1B. The outer cover 302 includes a bottom face 303 that is sloped downwardly and away from the heat-exchange tube 114 so as to direct flow of accumulated condensate away from the heat-exchange tube 114. A first aperture 304 is formed in the outer cover 302. When assembled, the first aperture 304 is fluidly coupled to the heat-exchange tube 114 via, for example, welding or another process. During operation, the outer cover 302 is susceptible to stresses caused, for example, by thermal expansion. Additionally, loss of heat energy through the outer cover 302 is possible since the outer cover 302 is often constructed of materials exhibiting high thermal conductivity.

Still referring to FIG. 2, in various embodiments, the heat-resistant liner 310 also includes a tubular member 308. The tubular member 308 is illustrated by way of example in FIG. 1B as being integrally formed with the heat-resistant liner 310; however, in other embodiments, the tubular member 308 may be formed separately from the heat-resistant liner 310 and joined to the heat-resistant liner 310 through any appropriate process. The tubular member 308 is also constructed of a nickel/chromium alloy such as, for example, INCONEL®; however, other heat-resistant materials could be utilized such as for example, a ceramic wafer board or other appropriate material. The tubular member 308 may be a mesh or solid. When assembled, the tubular member 308 extends through the first aperture 304 of the outer cover 302 and lines an interior of the heat-exchange tube 114. During operation, the heat-resistant liner 310 protects the outer cover 302 and the heat-exchange tube 114 from high temperatures generated by combustion of the hydrocarbon fuel/air mixture.

Figure 3A:
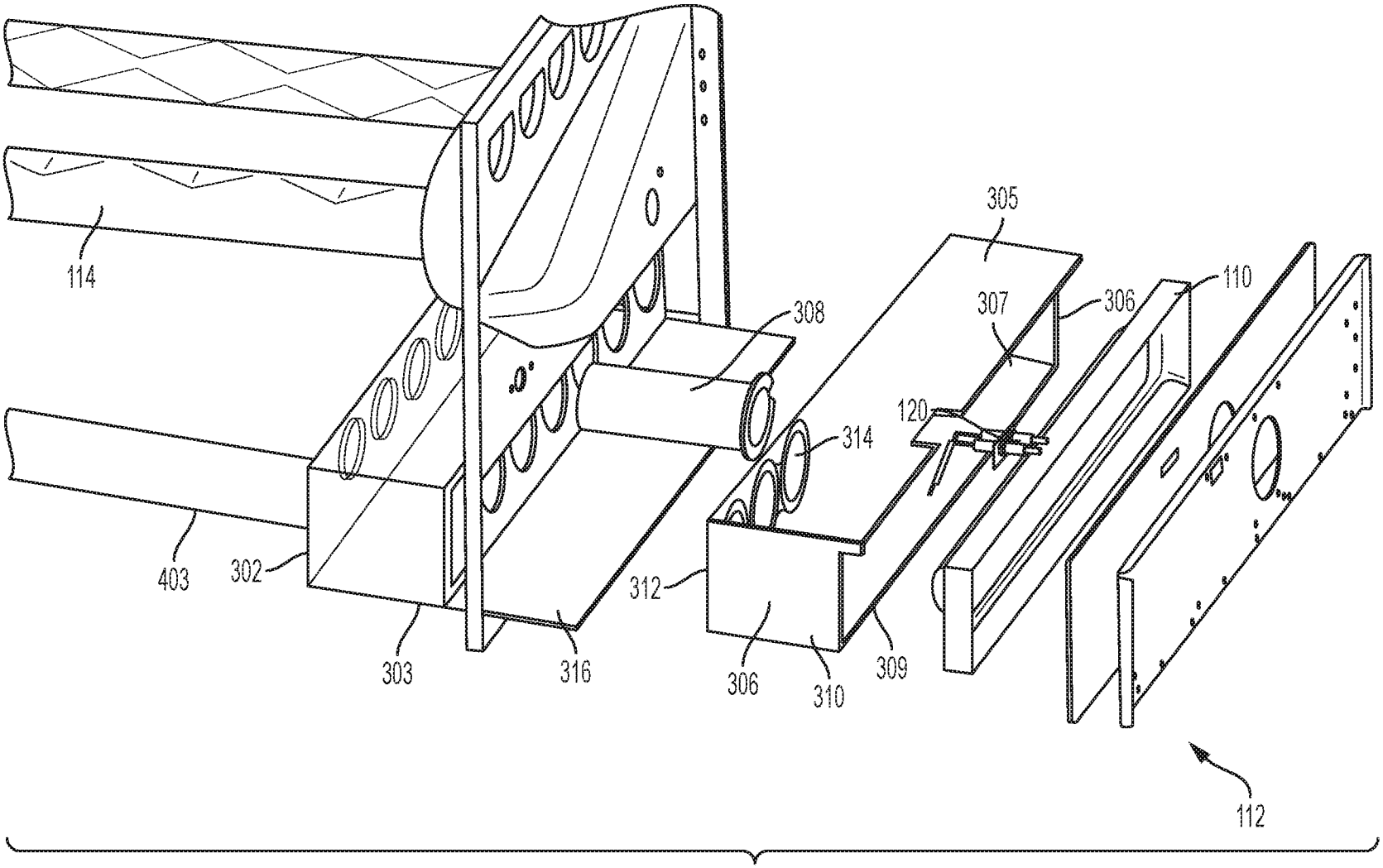
FIG. 3A is an exploded perspective view of the illustrative burner box assembly illustrating a shield disposed therein.
Figure 3B:
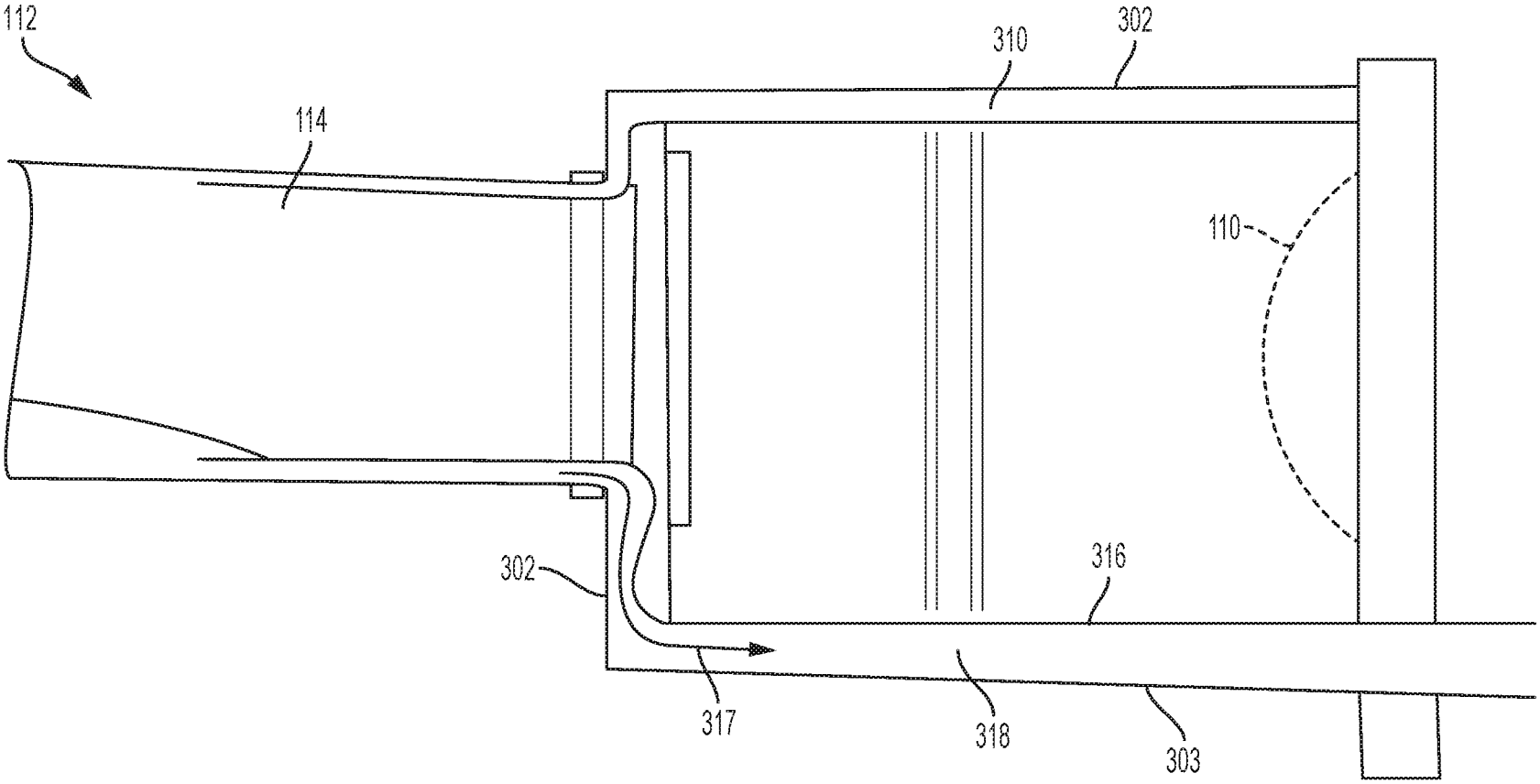
FIG. 3B is a side plan view of the burner box assembly of FIG. 3A showing a condensate flow path therethrough.

FIG. 3A is an exploded perspective view of the burner box assembly 112. FIG. 3B is a side plan view of the burner box assembly 112 showing a condensate flow path 317 therethrough. For purposes of illustration, FIGS. 3A and 3B will be discussed herein relative to FIGS. 1A and 1B. The heat-resistant liner 310 lines an interior of the outer cover 302. As mentioned above with respect to FIG. 1B, the heat-resistant liner 310 includes the oppositely-disposed spaced panel members 306, the top panel member 305, and the bottom panel member 309. The bottom panel member 309 is also disposed between, and generally perpendicular to, the oppositely-disposed, spaced panel members 306. A front panel 312 having a second aperture 314 formed therein is coupled to the oppositely-disposed, spaced panel members 306, the top panel member 305, and the bottom panel member 309. When assembled, the oppositely-disposed, spaced panel members 306, the top panel member 305, and the bottom panel member 309 line planar interior surfaces of the outer cover 302. In some embodiments, the oppositely-disposed, spaced panel members 306, the top panel member 305, and the bottom panel member 309 removably abut corresponding interior surfaces of the outer cover 302; however, the oppositely-disposed, spaced panel members 306, the top panel member 305, and the bottom panel member 309 are joined to corresponding interior surfaces of the outer cover 302 through an appropriate joining process. The front panel 312 lines an interior front aspect of the outer cover opposite the open rear face 307. The second aperture 314 aligns in registry with the first aperture 304 in the outer cover 302 in order to allow flow of combustion byproducts into the heat-exchange tube 114.

Still referring to FIG. 3A, a shield 316 is positioned between the heat-resistant liner 310 and the outer cover 302. The shield 316 is positioned between the heat-resistant liner 310 and the sloped bottom face 303 of the outer cover 302 such that an air gap 318 is formed between the shield 316 and the sloped bottom face 303 of the outer cover 302. In various embodiments, the shield 316 is formed of a corrosion-resistant material such as, for example, stainless steel. During operation, the heat-resistant liner 310 protects the outer cover 302 from the high-temperatures generated by combustion of the hydrocarbon fuel/air mixture.

Still referring to FIGS. 3A and 3B, during the cooling season, when the furnace assembly 100 is not operated, condensation will often accumulate on interior surfaces of the heat-exchange tube 114. The accumulated condensation typically drains out of the heat-exchange tube 114 towards the burner box assembly 112. The heat-resistant liner 310 may be formed of a hydroscopic material, which is susceptible to liquid infiltration and mold growth. In some embodiments, the liquid condensation flows out of the heat-exchange tube 114 and into the air gap 318 defined between the outer cover 302 and the shield 316. In this manner, the shield 316 protects the heat-resistant liner 310 from contact with liquid condensation and prevents damage to the heat-resistant liner 310.

Figure 4:
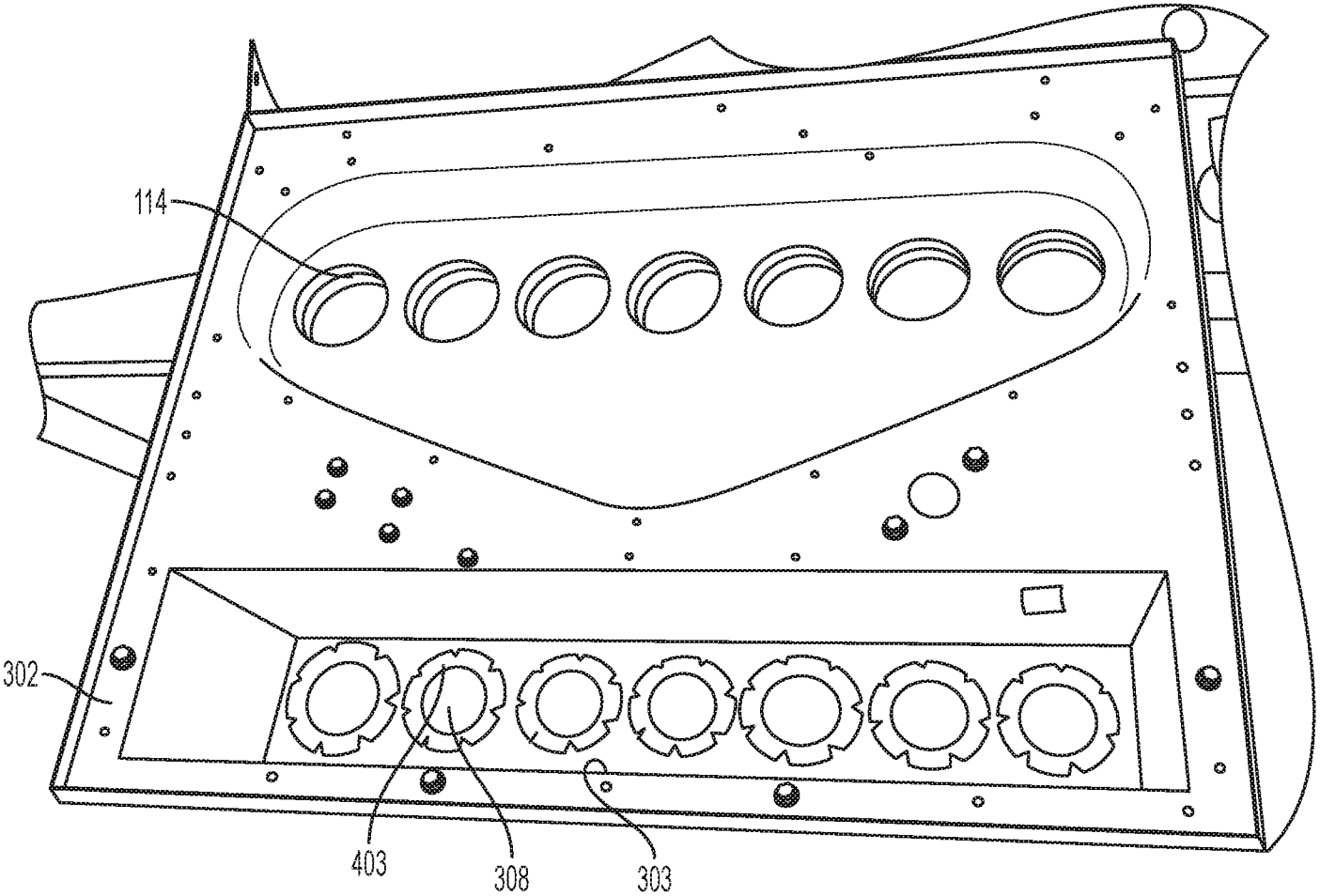
FIG. 4 is an interior perspective view of the illustrative burner box assembly showing a heat-exchange tube and a tubular member.

FIG. 4 is an interior perspective view of the burner box assembly 112 showing the heat-exchange tube 114 and the tubular member 308 in accordance with one or more aspects of the present disclosure. In FIG. 4, the heat-resistant liner 310 has been removed for clarity of illustration. In various embodiments, the tubular member 308 is utilized in combination with the heat-resistant liner 310 to further insulate and protect the burner box assembly 112. The tubular member 308 is generally tubular in shape and is sized to be received into the heat-exchange tube 114 at an end 403 of the heat-exchange tube 114 closest to the burner box assembly 112. The tubular member 308 may be constructed of, for example, a ceramic, a heat-resistant nickel/chromium alloy, or other appropriate material. In various embodiments, the tubular members 308 are constructed of refractory ceramic fiber (RCF), which is made from alumina-silicate fibers. RCF is stable and is capable of resisting combustion temperatures in excess of approximately 2,300° F. The tubular member 308 has a length of approximately five inches; however, the tubular member 308 could be constructed with a length in the range of less than one inch to more than ten inches. In this manner, a length of the tubular member 308 could be adjusted to move heat further down the heat-exchange tube 114 in an effort to prevent thermal damage to the heat-exchange tube 114. During operation, the tubular member 308 protects the end 403 of the heat-exchange tube 114 from the high-temperatures generated by combustion of the hydrocarbon fuel/air mixture. The tubular member 308 is illustrated by way of example in FIG. 4 as being formed separately from the heat-resistant liner 310; however, in other embodiments, the tubular member 308 may be integrally formed with the heat-resistant liner 310.

Figure 5:
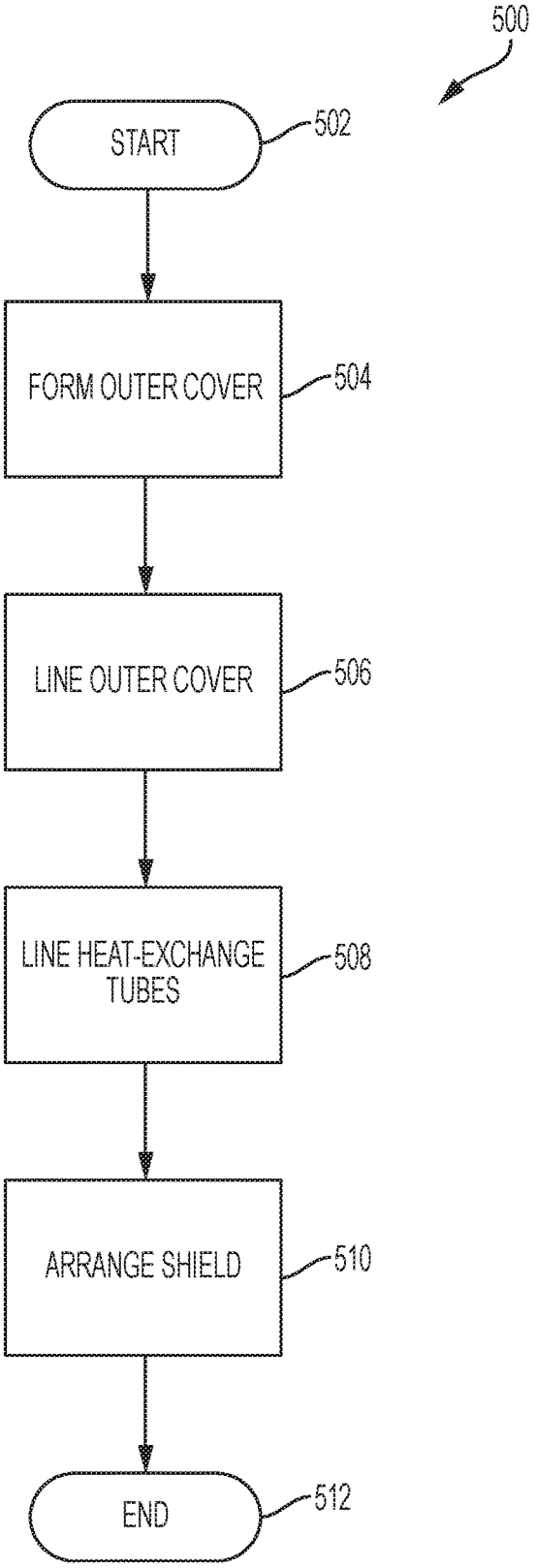
FIG. 5 is a flow diagram of a process for forming the illustrative burner box assembly in accordance with one or more aspects of the invention.

FIG. 5 is a flow diagram of an illustrative process 500 for forming a burner box assembly 112 in accordance with one or more aspects of the present disclosure. For purposes of illustration, FIG. 5 will be discussed herein relative to FIGS. 1A-4. The process 500 begins at block 502. At block 504, the outer cover 302 is formed. The outer cover 302 includes a bottom face 303 that is sloped downwardly and away from a junction with the heat-exchange tube 114. At block 506, the outer cover 302 is lined with the heat-resistant liner 310. The heat-resistant liner 310 may constructed of a nickel/chromium alloy such as, for example, INCONEL®; however, other heat-resistant materials could be utilized such as for example, a ceramic wafer board or other appropriate material. In various embodiments, the heat-resistant liner 310 may be a mesh; however, the heat-resistant liner 310 could be solid. At block 508, the heat-exchange tube 114 is lined with the tubular member 308. In various embodiments, the tubular member 308 may be separate or integral with the heat-resistant liner 310. At block 510, a shield 316 is arranged between the heat-resistant liner 310 and the outer cover 302. The shield 316 is constructed, for example, of a corrosion-resistant material and protects the heat-resistant liner from moisture infiltration resulting from, for example, drainage of accumulated condensation from the heat-exchange tube 114. The process 500 ends at block 512.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined by the language of the claims that follow. The term "comprising" within the claims is intended to mean "including at least" such that the recited list of elements in a claim are an open group. The terms "a," "an," and other singular terms are intended to include the plural forms thereof unless specifically excluded.

What is claimed is:

1. A burner box assembly comprising:

an outer cover having a top face and a sloped bottom face;

a liner disposed within the outer cover and comprising a plurality of panel members, wherein the plurality of panel members comprise oppositely disposed panels, a top panel member, and a bottom panel;

wherein the top face is generally parallel to the top panel member, wherein the sloped bottom face directs condensation away from a heat-exchange tube;

a shield disposed between the liner and the sloped bottom face such that an air gap is formed between the shield and the sloped bottom face; and a tubular member abutting at least one of the plurality of panel members.

2. The burner box assembly of claim 1, wherein the liner is heat-resistant and is constructed of a ceramic wafer board.

3. The burner box assembly of claim 1, wherein the tubular member is constructed of a ceramic wafer board.

4. The burner box assembly of claim 1, wherein the tubular member is constructed of a nickel-chromium alloy.

5. The burner box assembly of claim 1, wherein the liner is constructed of a nickel-chromium alloy.

6. The burner box assembly of claim 1, wherein the liner removably abuts interior surfaces of the outer cover.

7. The burner box assembly of claim 1, wherein the liner lines interior surfaces of the outer cover.

8. The burner box assembly of claim 1, wherein the liner comprises a mesh.

9. The burner box assembly of claim 1, wherein the tubular member has a length in a range of approximately one inch to approximately ten inches.

10. The burner box assembly of claim 1, wherein:

the outer cover comprises a first aperture formed therein and coupled to the heat-exchange tube;

the liner comprises a second aperture formed therein; and the first aperture aligns with the second aperture.

11. The burner box assembly of claim 1, wherein the liner comprises an open rear face that is configured to receive at least a portion of, and is thermally exposed to, a pre-mix burner.

12. A burner box assembly comprising:

an outer cover having a top face and a sloped bottom face;

a liner disposed within the outer cover and comprising a plurality of panel members, wherein the plurality of panel members comprise oppositely disposed panels, a top panel member, and a bottom panel;

wherein the top face is generally parallel to the top panel member, wherein the sloped bottom face directs condensation away from a heat-exchange tube; and a tubular member coupled to at least one of the plurality of panel members.

13. The burner box assembly of claim 12, wherein the liner is heat-resistant and removably abuts interior surfaces of the outer cover.

14. The burner box assembly of claim 12, wherein the liner lines interior surfaces of the outer cover.

15. The burner box assembly of claim 12, wherein the liner comprises an open rear face that is configured to receive at least a portion of, and is thermally exposed to, a pre-mix burner.

16. A burner box assembly comprising:

an outer cover having a top face and a sloped bottom face;

a liner disposed within the outer cover and comprising a plurality of panel members, wherein the plurality of panel members comprise oppositely disposed panels, a top panel member, and a bottom panel;

wherein the top face is generally parallel to the top panel member, wherein the sloped bottom face directs condensation away from a heat-exchange tube;

a shield disposed between the liner and the sloped bottom face such that an air gap is formed between the shield and the sloped bottom face;

a tubular member abutting at least one of the plurality of panel members;

wherein the liner is heat-resistant; and wherein the liner and the tubular member are constructed of a ceramic wafer board.

* * * * *